United States Patent [19]

Olsen

[11] Patent Number: 4,749,309

[45] Date of Patent: Jun. 7, 1988

[54] OFFSHORE PLATFORM STRUCTURE OF REINFORCED CONCRETE AND A METHOD OF PRODUCING SAME

[75] Inventor: Olav Olsen, Oslo, Norway

[73] Assignee: Norwegian Contractors, Stabekk, Norway

[21] Appl. No.: 922,477

[22] Filed: Oct. 23, 1986

[30] Foreign Application Priority Data

Oct. 23, 1985 [NO] Norway ..... 85.4227

[51] Int. Cl.[4] ..... E02B 17/02

[52] U.S. Cl. ..... 405/204; 405/203; 405/222

[58] Field of Search ..... 405/203, 204, 205, 207, 405/208, 209, 222, 223, 195

[56] References Cited

U.S. PATENT DOCUMENTS 3,165,898 1/1965 Elliott ..... 405/207
3,738,113 6/1973 Madary et al. ..... 405/205 X
3,961,489 6/1976 Mo ..... 405/207
3,990,254 11/1976 Mo ..... 405/203
4,234,270 11/1980 Gjerde et al. ..... 405/203 X
4,303,352 12/1981 Marion ..... 405/207 X

FOREIGN PATENT DOCUMENTS 2343863 10/1977 France ..... 405/204

*Primary Examiner*—Dennis L. Taylor
*Attorney, Agent, or Firm*—Fleit, Jacobson, Cohn & Price

[57] ABSTRACT

An offshore platform structure of reinforced concrete for standing on the bottom of a sea as a consequence of its own weight. The structure includes a base supporting a tower for a platform deck. The lower part of the tower includes a cylindrical portion extending downwardly towards and through the base and providing a skirt. A frusto-conical annular wall extends coaxially with the tower between the tower and the top of the base to provide an annular chamber with a triangular cross section. Also a method of building a platform structure includes building the lower portion of the structure in a dry dock and floating the lower portion out into deeper water for continuing a casting operation for the remainder of the platform structure.

6 Claims, 1 Drawing Sheet

OFFSHORE PLATFORM STRUCTURE OF REINFORCED CONCRETE AND A METHOD OF PRODUCING SAME

BACKGROUND OF THE INVENTION

The present invention concerns an offshore platform structure of reinforced concrete which is adapted to stand on the sea bottom owing to its own weight (gravitation platform) and includes a base supporting a tower constructed integrally with the base and adapted to support a deck. The invention concerns also a method of producing the platform structure. In the method, the lower section of the platform structure is built in a dry dock and then floated out to deeper water for continued casting of the remainder of the structure.

The object of the invention is to provide a platform structure of the above mentioned kind which is relatively easy to produce and which allows for casting in a dry dock a substantially greater part of the platform than has been possible up to the present. It is obvious that shuttering work, casting work, etc., are more easily carried out in a dry dock than in deep water. Therefore, the building work can be carried out better as well as quicker.

SUMMARY OF THE PRESENT INVENTION

The platform structure according to the invention distinguishes itself substantially by the fact that the lower section of the tower includes a cylindrical portion extending downwardly towards and through the base and providing a skirt, a conical annular wall extending coaxially with the tower between the tower and the base to provide an annular chamber having substantially triangular cross section. The base of the structure is substantially made with a circular rim of contiguous cylindrical cells having no bottom and having a closed top, the conical annular wall extending from the top edge of the cylindrical tower portion to the pitch circle of the cells in the top plane thereof.

The cylindrical tower portion is preferably closed at the top and at the lower end with a top wall and a bottom wall, respectively convexly shaped downwardly to provide a closed cylindrical tower chamber. The structure is preferably carried out with vertical radial partition walls extending between the cylindrical tower portion and the contact lines of the cell walls and supporting the base top. Advantageously, a cylindrical shaft extends from the bottom of the cylindrical tower chamber through the chamber top and a distance into the upper portion of the tower.

In an advantageous embodiment of the invention the diameter and the wall thickness of the tower increases smoothly from a joint circle where the cylindrical portion, the chamber top and the conical annular wall join each other, and the top of the chamber and the lower portion of the conical tower section extending above the joint circle include a very substantially greater wall thickness than the portions of the structure located below the joint circle. At least three closed, substantially cylindrical chambers are provided in the annular chamber to accommodate a float medium or ballast medium respectively.

The method of building the platform structure distinguishes itself substantially by the fact that a portion (the lower portion) of the platform structure comprising the base and the cylindrical tower portion as well as the conical annular wall is built in dry dock by casting concrete using vertical slide and declined slide techniques.

In an embodiment of the method, a central vertical shaft is cast when casting the lower portion, the shaft extending from the base and extending substantially above the top of the cylindrical chamber section, the shaft being used as a central guide control for the declined slide shutterings when decline slide casting the upper frusto-conical portion of the tower up to a location wherein the diameter of the tower becomes so small that a central guiding of the shuttering appears superfluous.

The lower portion of the platform structure comprising the base, the cylindrical tower portion and the conical (frusto-shaped) annular wall is made with a very substantially less wall thickness than the remaining (upper) portion of the tower of the platform structure where the transition starts from the cylindrical portion of the tower.

These and other objects of the invention, as well as many of the intended advantages thereof, will become more readily apparent when reference is made to the following description taken in conjunction with the accompanying drawings.

BRIEF DESCRIPTION OF THE DRAWINGS

The invention shall be explained with reference to the drawing, wherein.

DESCRIPTION OF THE PREFERRED EMBODIMENTS

Figure 2:
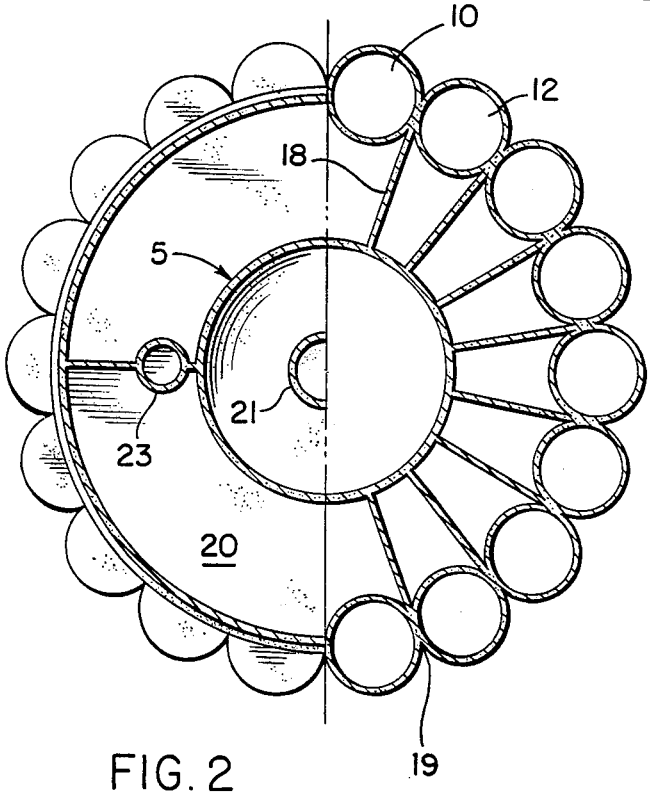
Figure 1:
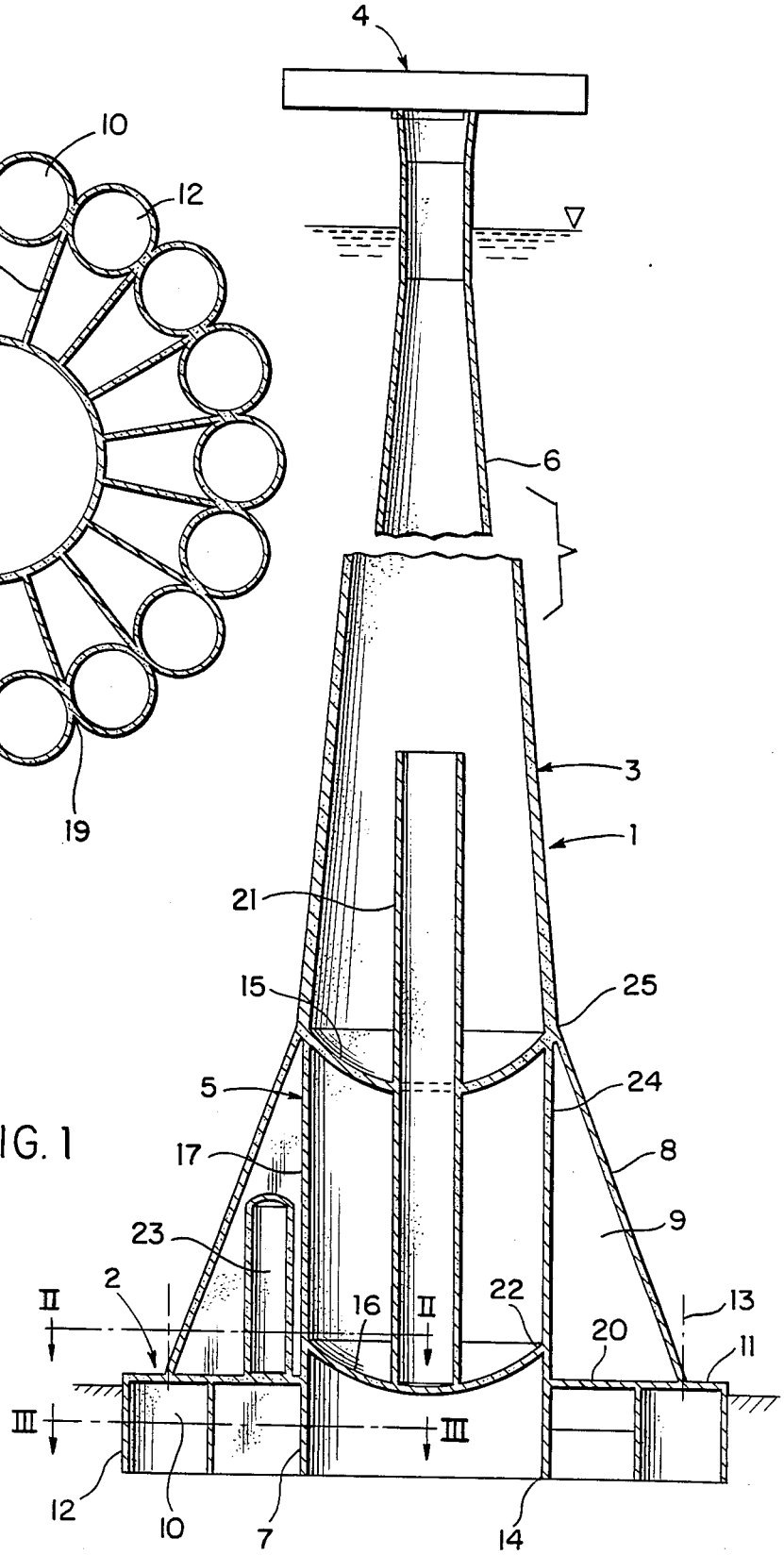
FIG. 1 is a schematic vertical axial sectional view through a platform structure made in accordance with the invention, and FIG. 2 includes on its left side, a horizontal sectional view along the line II—II in FIG. 1, and includes on its right side, a horizontal sectional view along the line III—III in FIG. 1.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

The platform structure 1 shown in the drawing includes a base 2 supporting a tower 3 made integrally with the base and adapted to support a deck 4. The tower 3 is made with a cylindrical portion 5 and a frusto-conical portion 6 merging into a cylindrical portion which widens again conically toward the top which supports the deck 4. The lower part of the cylindrical portion extends downwardly towards and through the base 2 and provides a cylindrical skirt 7 having a lowermost edge 14.

The base 2 is made with a circular rim of contiguous, vertical, cylindrical cells 10 without a bottom and having a closed top wall 11. The cell top wall 11 extends radially inwardly towards the cylindrical tower portion 5 to provide a continuous top 20. Between the zones 19 of contact between the individual cell walls 12 and the cylindrical skirt 7, radial partition walls 18 are about the same height as the cylindrical cells 10 and the skirt 7 and support the inner portion of the base top 20.

The cylindrical tower portion 5 is closed at the top with a downwardly convexly shaped top wall 15, the peripheral edge of the top coinciding with the merging circle 25 located between the cylindrical tower portion 5 and the frusto-shaped tower portion 6. At its bottom, the cylindrical tower portion is closed with a bottom wall 16 being downwardly convexly shaped. Its peripheral edge 22 is cast integrally with the cylindrical tower portion wall as is top wall 15. The peripheral edge 22 is located in a plane at a distance above the base top 20 and the lowest central portion of bottom wall 16 is located at a distance below the plane of the base top 20. The top 15, the bottom 16 and the peripheral wall 24 of the cylindrical portion 5 define a substantially cylindrical chamber 17.

A cylindrical shaft 21 extends a distance into the frusto-conical portion 6 of the tower, centrally from the bottom 16 of the chamber 17 and through the chamber top wall 15. The numbers 15 and 16 are commonly called "domes".

A frusto-conical wall 8 extends between the base top 11, 20 and the merging circle 25 which is located between the cylindrical tower portion 5 and the frusto-conical tower portion 6. The lower edge of the frusto-conical wall 8 is located on a circle 13 coinciding with the pitch circle of the base cells 10 in the plane of the top of the base. Thus, the circle line 25 provides a junction line along which the cylindrical wall 24 of the chamber 17, the chamber top 15, the frusto-conical wall of the tower portion 6 and the frusto-conical wall 8 join each other. The cylindrical wall 24, the frusto-conical wall 8 and a portion of the base top 11, 20 define an annular chamber 9 having a triangular cross section. At least three vertical, cylindrical chambers 23 are provided in the annular chamber 9 regularly distributed around the peripheral extension of the chamber. The chambers 23 are arranged for being filled with a buoyancy medium or ballast medium, respectively and, thus, serve for trimming or stabilizing the platform in floating condition.

A portion of the platform structure is located below the level of the junction circle 25. This portion comprises the base 2, the cylindrical tower portion 5 and the frusto-conical annular wall 8 which are made with a very substantially less wall thickness than the lower portion of the frusto-conical tower portion 6 which starts at the edge circle or junction circle 25 and continues upwardly with decreasing diameter and decreasing wall thickness. As the lower portion (downwardly from the junction circle 25) of the tower structure with the wall thickness which has been used, is not able to withstand the water pressure at the depth of actual use, the lower portion is made so that the annular chamber 9, with triangular cross section, and the cylindrical chamber 17 are filled with water as the platform is submerged. The frusto-conical tower portion 6, however, is made with a wall thickness which will withstand full water pressure at the actual installation site. The top of the chamber 17 is dimensioned for withstanding full water pressure at the installation site. The water pressure will then act from below through the water filled cylindrical chamber 17. Therefore, the convex wall of the top 15 faces downwardly.

The new structure allows that at least the whole lower portion of the structure and possibly a portion of the conical tower portion 6 can be produced in dry dock. With reduced wall thickness in the lower portion relative to the upper portion, it is therefore possible to float the lower portion out of dry dock even with a total height of the floating portion being over 100 meters. In the dry dock "vertical slide" with constant diameter is used for production of the cylindrical section and varying diameter is used to produce the frusto-conical wall portions of the lower section. The shuttering for inclined casting of the tower portion 6 is mounted in the dry dock and the casting operation is started in the dry dock. To what height level the operation can be continued will be dependent on what weight can be allowed for lifting out the lower portion from the dry dock.

The new structure makes it possible to use inclined slide casting for platform structures having very large diameter. The cylindrical shaft 21 in the center of the structure is utilized as well for stabilizing as for guiding (adjusting) the incline slide shuttering for the frusto-conical wall of the tower portion 6.

The platform structure is designed for great depths. The embodiment shown and explained in the example can without further ado be operated in depths down to 400 meters. It is clear that the invention is not limited to the embodiment shown in the drawing and discussed aforehead. For example, the height of the cylindrical portion 5 relative to the frusto-conical portion 6 can vary from embodiment to embodiment and the same applies for the height and the angle for the frusto-conical annular wall 8.

Having described the invention, many modifications thereto, will become apparent to those skilled in the art to which it pertains without deviation from the spirit of the invention as defined by the scope of the appended claims.

I claim:

1. An offshore platform structure of the type which stands on the bottom of the sea as a consequence of its own weight, said structure comprising;

a base including a substantially horizontal base top having vertically extending elements extending downward from said base top to be pressed into the sea bed, a monotower made integrally with and supported by said base and adapted to support a deck, a lower portion of said monotower including a cylindrical portion extending downwardly towards and through said base, said cylindrical portion including a cylindrical skirt and at least a mid-portion of said monotower having a conical shape with a larger lowermost diameter than an uppermost diameter, and a frusto-conical annular wall extending coaxially with said monotower between said monotower and said base, said monotower and said base together with vertically arranged partitions form annular chambers having substantially a triangular cross section in the vertical plane.

2. A platform structure as claimed in claim 1, wherein said base includes a circular rim of contiguous cylindrical cells being open at its bottom and having a closed top and said frusto-conical annular wall extends from a top edge of said cylindrical portion to a pitch circle of said cells in a top plane of said cells.

3. A platform structure as claimed in claim 1, wherein said cylindrical portion is closed at its top and closed at a lower end spaced a distance from a lower edge by a downwardly convex top and a downwardly convex bottom, respectively, to provide a closed cylindrical tower chamber.

4. A platform structure as claimed in claim 3, wherein vertical, radial partition walls extend between said cylindrical skirt and contact lines between walls of said cells to support a base top.

5. A method of building an offshore platform structure, said method comprising producing a lower portion of the structure including a base, a cylindrical tower portion and a frusto-conical annular wall in a dry dock using vertical slide techniques with constant diameter for said cylindrical tower portion and varying diameter for said frusto-conical annular wall, and floating out said lower portion to deeper water for continuing a casting operation wherein a central vertical shaft is cast extending substantially from the base and substantially over a top of said cylindrical tower portion and said shaft is used as a central guide for inclined slide shutterings when inclined slide casting an upper portion of the tower, said upper portion being frusto-conical until the diameter of the tower reaches a predetermined dimension where central guiding of the inclined slide shuttering is superfluous.

6. A method as claimed in claim 5, wherein said lower portion is cast with a very substantially less wall thickness than an upper portion of the structure.

* * * * *